US006575549B1

(12) United States Patent
Silverbrook

(10) Patent No.: US 6,575,549 B1
(45) Date of Patent: Jun. 10, 2003

(54) INK JET FAULT TOLERANCE USING ADJACENT NOZZLES

(75) Inventor: Kia Silverbrook, Balmain (AU)

(73) Assignee: Silverbrook Research Pty Ltd, Balmain (AU)

( * ) Notice: Subject to any disclaimer, the term of this patent is extended or adjusted under 35 U.S.C. 154(b) by 0 days.

(21) Appl. No.: 09/607,498

(22) Filed: Jun. 30, 2000

(51) Int. Cl.[7] ..... B41J 29/393; B41J 29/38
(52) U.S. Cl. ..... 347/19; 347/14
(58) Field of Search ..... 347/19, 41, 43, 347/9, 56–67, 14, 23, 15, 16, 11–12, 10, 8, 20; 400/82

(56) References Cited

U.S. PATENT DOCUMENTS 5,040,003 A * 8/1991 Willis ..... 347/118
6,203,140 B1 * 3/2001 Oyen ..... 347/41
6,318,828 B1 * 11/2001 Barbour et al. ..... 347/9

FOREIGN PATENT DOCUMENTS

| | | |
|---|---|---|
| EP | 981105 | 2/2000 |
| EP | 983855 | 3/2000 |
| WO | 96/32272 | 10/1996 |
| WO | 98/43817 | 10/1998 |
| WO | 99/08875 | 2/1999 |

* cited by examiner

*Primary Examiner*—Craig Hallacher
*Assistant Examiner*—Charles W. Stewart

(57) ABSTRACT

A printing method identifies where parts of an image will not be printed due to device failure and if possible shifts ink dots sideways or lengthways to adjacent rows or columns so as to lessen the visual effect of failure to print at the original location.

20 Claims, 2 Drawing Sheets

INK JET FAULT TOLERANCE USING ADJACENT NOZZLES

FIELD OF THE INVENTION

This invention relates to digital printing and more particularly to printing using devices which eject ink onto the printed substrate. However, the invention is not limited to ink ejection devices and is also applicable to laser, light emitting diode printers and to digital photocopiers.

BACKGROUND OF THE INVENTION

In ink ejection devices a printhead has an array of nozzles through which ink is selectively ejected onto the substrate as the substrate moves relative to the printhead. The printhead may print by scanning across the substrate to print horizontal bands or, if it is a full page width printhead, it may pass along the length of the page. A blocked nozzle will result in multiple horizontal blank lines, in the case of a scanning type printhead, or a blank vertical line in the case of a page width printhead. Such blank lines are undesirable since they detract from the printed result.

The present invention provides a method of modifying the printing of an image so as to reduce or effectively eliminate the visual effect of one or more such blocked nozzles apparent to the eye of an observer in normal use. However, the invention is applicable to other forms of printing where a device, whether passive or active, is repeatedly used to produce dots of ink or the like on a substrate. The invention has potential application to laser and LED type printers and photocopiers where a fault in the imaging drum or light source can result in repeated faults in the image produced. As used above and throughout the description and claims the term image is to be understood to have a broad meaning and includes anything printed, such as text and line drawings.

DISCLOSURE OF THE INVENTION

In one broad form the invention provides a method of modifying an image to be printed by a digital printing device to compensate for failure of the device to print ink correctly at one or more specific locations, the method including the steps of identifying said specific location or locations and for at least one specific location shifting the printed position of the dot intended for the specific location in the image to a shifted location not already used by another dot of the image.

In another broad form the invention also provides a printer having a row of devices which cause rows of dots to be deposited onto a substrate and means to move the substrate relative to said row of devices in a direction generally perpendicular to said row of dots, said printer including:

a) means to determine if one or more of said devices is not operating correctly;

b) control means to analyse images to be printed and to identify when a dot of ink should be printed by activation of the failed device and to shift the position of the dot in the printed image such that the dot is printed by activation of one of the devices on either side of the failed device.

The ink dots originally intended to be printed by the defective device may be shifted transversely longitudinally or both transversely and longitudinally. Preferably the ink is shifted to a location immediately adjacent to the original location.

The defective device will result in a defect line or lines in the image printed and preferably the ink is shifted to lie on alternate sides of the line or lines. Preferably, the ink is only shifted side-ways relative to the line, but if no location is available in the same row, the ink may be shifted both longitudinally and transversely and longitudinally along the line. The ink may be shifted to a row before or a row after the original row location.

BRIEF DESCRIPTION OF THE DRAWINGS

The invention shall be better understood from the following non-limiting description of preferred embodiments and the drawings, in which.

DESCRIPTION OF PREFERRED AND OTHER EMBODIMENTS

Figure 1:
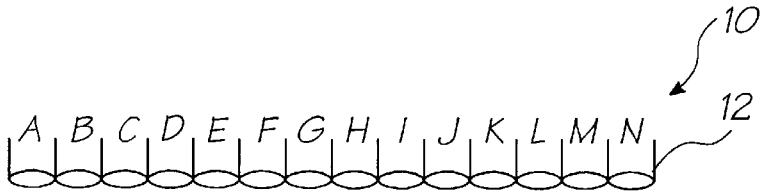
FIG. 1 shows a schematic illustration of a set of nozzles of an ink jet printing head.

Referring to FIG. 1, a printhead 10 has an array of ink jet nozzles 12 arranged in a singe line. For the purpose of explanation only 14 nozzles are shown but in practice there will be from tens to thousands of nozzles arranged in a line. Paper is passed underneath the printhead in a direction generally perpendicular to the line of ink jet nozzles, as indicated by arrow 14. The printhead may be a stationary or a movable printhead. As the paper passes under the printhead the ink jet nozzles A to N are selectively operated to cause an array of ink dots to be placed on the paper. This array is a series of columns and rows, the spacing of which is dependent on the spacing of the inkjet nozzles and the minimum paper feed step respectively. Whilst it is preferred that the horizontal and vertical spacing of the dots is the same, this is not necessarily achievable due to the different sources of the spacing. The printhead may be a page width printhead or a smaller printhead which scans across the page to lay down a series of transverse bands of printing.

For the purposes of explanation it is assumed that inkjets a–g and i–n inclusive are operating correctly but, for whatever reason, inkjet h is not operating correctly or at all. It is also assumed that the diagnostic systems of the printer, which will be well understood by those skilled in the art, have detected that nozzle h is not functioning correctly. In most cases, a malfunctioning device will be partially or totally blocked resulting in insufficient or no ink being deposited on the paper.

Figure 2:
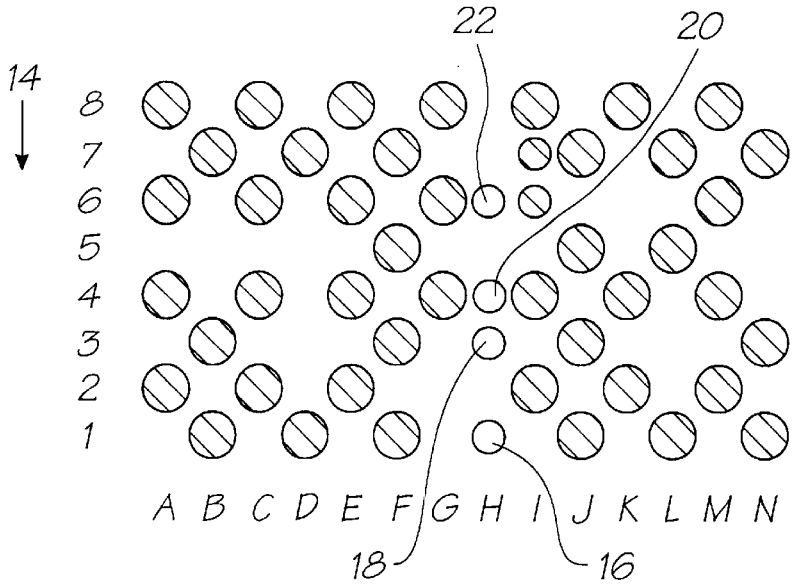
FIG. 2 shows a schematic illustration of an array of ink dots formed by the printhead of FIG. 1 without fault correction operational.
Figure 3:
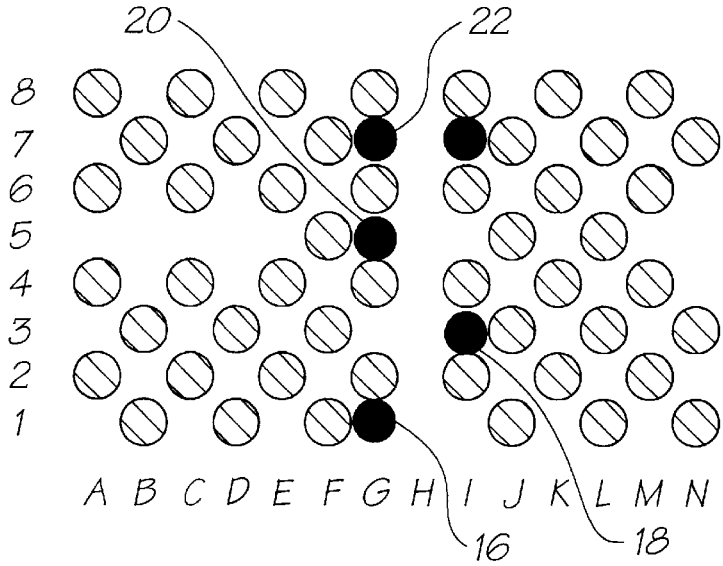
FIG. 3 shows a schematic illustration of the same array of ink dots as in FIG. 2 formed by the printhead of FIG. 1, but with fault correction operational.
Figure 4:
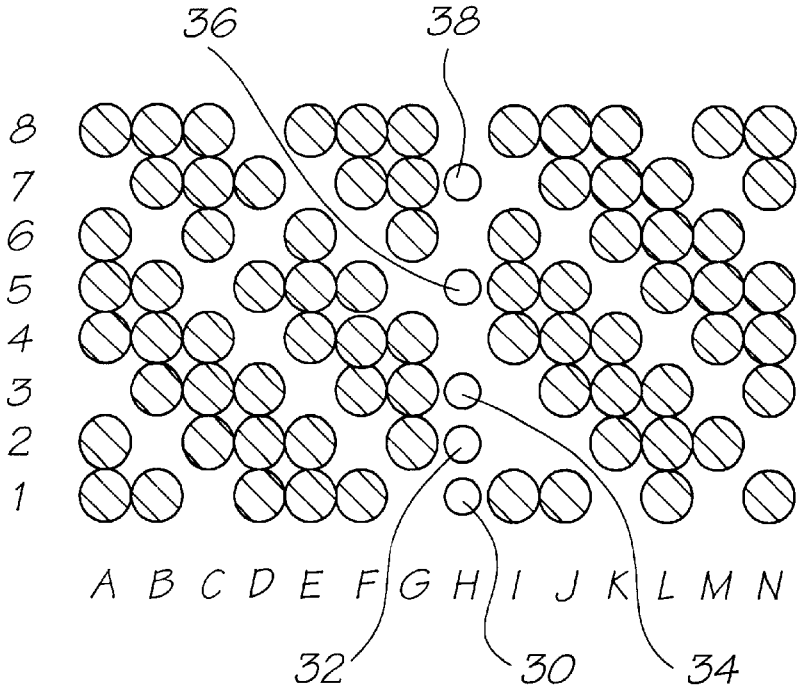
FIG. 4 shows a second schematic illustration of an array of ink dots formed by the printhead of FIG. 1 without fault correction operational.

Referring to FIG. 2, which schematically shows a portion of printing performed by the printhead 10 without fault correction, there is a blank column, labelled "h" corresponding to inkjet h, whilst columns a–g and i–n have been correctly selectively printed. This leads to one or more blank lines appearing in the printing depending on whether the printhead 10 is a full page width printhead or a scanning type printhead. The unshaded circles numbered 16, 18, 20 and 22 represent drops of ink which should have been printed in column h but were not. FIG. 3 shows the same image printed by the printhead 10 but with fault correction according to an embodiment of the invention operational.

As mentioned, the paper is fed past the printhead in the direction of arrow 14 so that row 1 is printed first. At row 1, column h, dot 16 should be printed. Since nozzle h is not functioning, the control system determines if adjacent nozzles g and i need an ink dot. Since both do not need an ink dot, the control system semi-randomly selects one of column g and i to place a dot in the respective column instead of in column h.

Normally the control system alternates the side of the defective nozzle on which to print extra ink drops and so the side preferred, at first instance, is the opposite to the side last printed. Obviously there will be cases where there is no previous data, such as immediately after the nozzle has been detected as being defective or where the printer has been re-initialised. In such cases it is random whether the left or right column is chosen is random.

Both columns g and i are "free" and so the system places a single dot at position g, on the basis of the criteria explained above.

Row 2 does not have a dot at column h, so no extra dot is produced.

Row 3 has a dot 18 required at column h and again columns g and i are free. Because the last extra dot printed (at row 1) was printed in column g, the extra dot is printed in column i.

Row 4 also has a dot 20 intended for column h but in this case dots are required at both columns g and i. Therefore no extra dot is printed in row 4. However, at row 5 no dot is required in column h and both columns g and i are free. Because the last extra dot was printed in column i, column g, row 5 is selected to print the dot originally intended for column h, row 4.

Row 6 also has a dot 22 required at column h but again both columns g and i are already used so the need for an extra dot is carried over to the next row, row 7. No dot is needed at row 7, column h or at column g, but a dot is required at column i. It will be recalled that dot 20 was placed in column g and so the first preference would be to place dot 22 in column i. However, this is already needed so the system places the dot in column g, even though this results in successive extra dots in column g. Whilst this may result in an imbalance on a microscopic scale, on a macroscopic scale this tends to average out.

Figure 5:
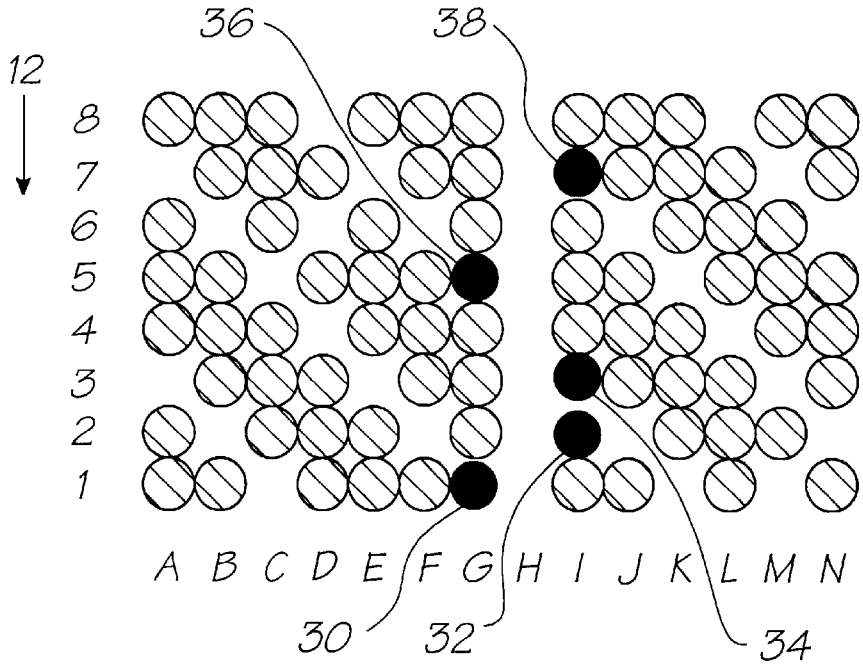
FIG. 5 shows a schematic illustration of the same array of ink dots as in FIG. 4 formed by the printhead of FIG. 1 but with fault correction operational.

FIGS. 5 and 6 show two sets of print where, on average, more dots are required than in FIGS. 2 and 3. Again, nozzle h is not functioning correctly. Again row 1 is printed first and a dot 30 is required in column h. As only column g is free, dot 30 is placed in column g. Rows 2 and 3 also require dots in column h but because column g is unavailable, both of dots 32 and 34 are placed in column i, not withstanding any "need" to alternate sides.

No dot is required in row 4 or 6 but dots are required at rows 5 and 7. Again, due to only one row being available, dots 36*a* and 38 are placed in rows g and i respectively.

Also, within the scope of the invention is the printing of oversize dots in unshifted locations next to or adjacent the unprinted location and/or the printing of extra dots between the rows adjacent or next to the unprinted location.

Whilst the techniques described only consider rows printed after the original row in determining where to place dots, it will be appreciated that a look ahead feature may also be utilised to place dots in rows printed before the original row. For example, if using the look behind criteria a dot should be placed to the right of the failed nozzle, but looking ahead it is apparent that dots will be normally required in that column for the next few rows, then a better result may be to place the dot in the left hand column of the original row. Similarly, the embodiments described may also translate the dot to the next row printed after the normally desired position. By using a look ahead feature the dot may be printed in the row before the normally desired position if a better result will occur.

It will also be appreciated that this technique may be used with laser and LED printers and photocopiers and other types of digital printers where the placement of an ink dot is dependent on individual activation of a device or component. For example, an LED in a LED printer may fail or there may be a defect in the photoconductive imaging drum of a laser printer. In both cases, shifting of dots can hide or reduce the visual effect of the defect in the device or component.

I claim:

1. A method of modifying an image to be printed by a digital printing device to compensate for failure of the device to print ink correctly at one or more specific locations, the method including the steps of:

a) identifying said specific location or locations;

b) for at least one specific location shifting the printed position of the ink intended for the specific location in the image to an alternative, shifted, location in the image.

2. The method of claim 1 wherein the respective ink is shifted transversely.

3. The method of claim 1 wherein the respective ink is shifted longitudinally.

4. The method of claim 1 wherein the respective ink is shifted both transversely and longitudinally.

5. The method of claim 1 wherein, when the ink may be shifted to two or more possible locations, the shifted location chosen is influenced by the position of any nearby shifted ink or most recently printed shifted ink, or both.

6. The method of claim 1 wherein, when the image includes a multiple number of specific locations arranged in a line, said shifted locations are located approximately 50% to one side of the line and 50% to the other side of the line.

7. The method of claim 1 wherein, when the image includes a multiple number of specific locations arranged in a line the ink is shifted relative to the line:

a) transversely only, or b) transversely and longitudinally.

8. The method of claim 1 wherein the shifted location is immediately adjacent, transversely or longitudinally or both, to the original location.

9. The method of claim 1 wherein additional ink is printed adjacent the respective specific locations in the form of oversize drops of ink.

10. The method of claim 1 wherein additional ink is printed adjacent the respective specific location in the form of extra drops of ink.

11. A printer having a row of devices which cause rows of dots to be deposited onto a substrate and means to move the substrate relative to said row of devices in a direction generally perpendicular to said row of dots, said printer including:

a) means to determine if one or more of said devices is not operating correctly;

b) control means to analyse images to be printed and to identify when a dot of ink should be printed by activation of the failed device and to shift the position of the dot in the printed image such that the dot is printed by activation of one of the devices on either side of the failed device.

12. The printer of claim 1 wherein the control means determines if either of the adjacent devices is required to print a dot in the same row as the original location and if neither is already required, activates one of the adjacent devices to print the dot in the same row as the original location.

13. The printer of claim 11 wherein if the control means determines if one of the adjacent devices is already required the control means activates the other of the adjacent devices to print the dot in the same row as the original location.

14. The printer of claim 11 wherein if the control means determines if neither adjacent device is available, the control means determines if either is available to be activated to print the dot in the preceding or subsequent row and selectively activates one of said adjacent devices to print said dot in the preceding or subsequent row.

15. The printer of claim 11 wherein the control means only activates devices immediately adjacent the respective failed device to print dots originally intended to be printed by activation of the failed device.

16. The printer of claims 9 and 11 wherein the devices are ink ejection devices.

17. The printer of claim 11 wherein the devices are light emitting devices.

18. The printer of claim 11 wherein the devices are each areas of a photoconductive imaging drum.

19. The printer of claim 11 being an ink ejection printer and said devices are ink ejection devices and wherein said control means is operable to activate said adjacent devices to cause printing of larger ink dots.

20. The printer of claim 11 wherein said selected adjacent device is activated at a higher frequency than the other devices to cause deposition of ink between said rows.

* * * * *